United States Patent [19]

Reavis, Jr. et al.

[11] 4,202,589

[45] May 13, 1980

[54] FUSE HOLDER

[75] Inventors: Robert P. Reavis, Jr., Statesville; Melvin A. Soderstrom, Advance; Vasantrai A. Vachhani, Kernersville; Richard L. Hughes, Clemmons, all of N.C.

[73] Assignee: AMP Incorporated, Harrisburg, Pa.

[21] Appl. No.: 945,660

[22] Filed: Sep. 25, 1978

[51] Int. Cl.[2] ..... H01R 11/20

[52] U.S. Cl. ..... 339/97 R; 339/147 R; 339/DIG. 2

[58] Field of Search ..... 339/89, 97 R, 97 P, 339/147, 255 R, 258 RR, DIG. 2

[56] References Cited

U.S. PATENT DOCUMENTS

| | | | |
|---|---|---|---|
| 1,601,673 | 9/1926 | Bridgman | |
| 2,292,320 | 8/1942 | Hammerly | 200/134 |
| 3,066,272 | 11/1962 | Quackenbush | 339/89 |
| 3,085,138 | 4/1963 | Brown et al. | 200/115.5 |
| 3,170,748 | 2/1965 | Van Horssen | 339/88 |
| 3,356,806 | 12/1967 | Urani | 339/147 R |
| 3,417,359 | 12/1968 | Urani | 337/201 |
| 3,892,458 | 7/1975 | Clark | 339/DIG. 2 |
| 3,897,128 | 7/1975 | Reavis, Jr. | 339/97 R |

FOREIGN PATENT DOCUMENTS

| | | | |
|---|---|---|---|
| 2148805 | 4/1973 | Fed. Rep. of Germany | 339/258 RR |
| 173953 | 1/1961 | Sweden | 339/258 RR |
| 527120 | 10/1940 | United Kingdom | 339/258 RR |
| 1006621 | 10/1965 | United Kingdom | 339/97 P |

OTHER PUBLICATIONS

IBM, Panaro, Clicking Connector, Dec. 1958, vol. 1, No. 4, p. 15.

*Primary Examiner*—Joseph H. McGlynn
*Attorney, Agent, or Firm*—Gerald K. Kita

[57] ABSTRACT

A fuse holder includes a pair of electrical terminals which releasably clamp opposite ends of a fuse. Each terminal has a wire terminating, slitted barrel portion to which wires are connected without a need for tools. The fuse and the terminals are enclosed within a two piece dielectric housing adjustable in length to accept a range of fuse lengths. Means are provided to prevent undesired loosening or opening of the housing.

7 Claims, 9 Drawing Figures

FUSE HOLDER

FIELD OF THE INVENTION

The present invention relates to a fuse holder and more particularly to a device which electrically connects wires to a readily replaceable fuse of the cartridge type.

BACKGROUND OF THE ART

U.S. Pat. Nos. 3,453,578 and 3,432,788, respectively discloses a typical fuse holder. In each, wire connections to electrical terminals were made by crimping. Such crimping requires a hand tool.

U.S. Pat. No. 3,356,806 discloses a fuse holder having projecting ribs, some of which prevent removal of a threaded nut, and some of which snuggly fit within keyway grooves to prevent relative rotation of two housing parts.

SUMMARY OF THE INVENTION

According to the present invention, electrical terminals are provided with wire terminating barrel portions to which wires are electrically connected without the use of tools. The terminals further include resiliently expandable socket portions providing removable connections to a cartridge type fuse. An open seam of each socket allows for expansion to accommodate fuses of different diameters. Each socket is provided with integral flanges entering the open seam for gripping the circumference of a fuse in two different locations longitudally spaced along the fuse. The terminals are contained within a two piece housing which is readily adjusted in length to accommodate fuses of different lengths. The two pieces of the housing include telescoping portions provided with a threadable coupling. An aperture is provided in a helical groove of one housing portion. A projection on a helical rib of a second housing portion frictionally fits within the groove as the rib is threadably traversed along the groove to threadably secure together the housing portions. The projection will latch within the aperture to prevent undesired separation of the housing portions.

OBJECTS

An object of the present invention is to provide a fuse holder to which wires may be connected electrically without the need for tools.

Another object of the present invention is to provide a fuse holder, which accommodates fuses of different lengths, which includes electrical terminals to which wires are electrically connected without a need for tools, and in which two portions of the fuse holder are threadably secured together and are frictionally retained.

Another object of the present invention is to provide a fuse holder with a housing having two separable portions which are threadably connected and which are frictionally secured together with a projecting latch, the latch being captivated in an aperture to prevent undesired separation of the housing portions.

Another object of the present invention is to provide a fuse holder with electrical terminals, each having a fuse receiving socket provided with a longitudinal open seam and two integral flanges entering the open seam for gripping the circumference of the fuse in two different locations longitudinally spaced along the fuse.

Other objects and many attendant advantages of the present invention will become apparant from the following detailed description taken in conjunction with the accompanying drawings.

DESCRIPTION OF THE DRAWINGS

FIG. 8 is an enlarged view of an electrical terminal portion of the fuse holder according to the present invention.

FIG. 9 is a perspective of the terminal portion.

DETAILED DESCRIPTION

Figure 1:
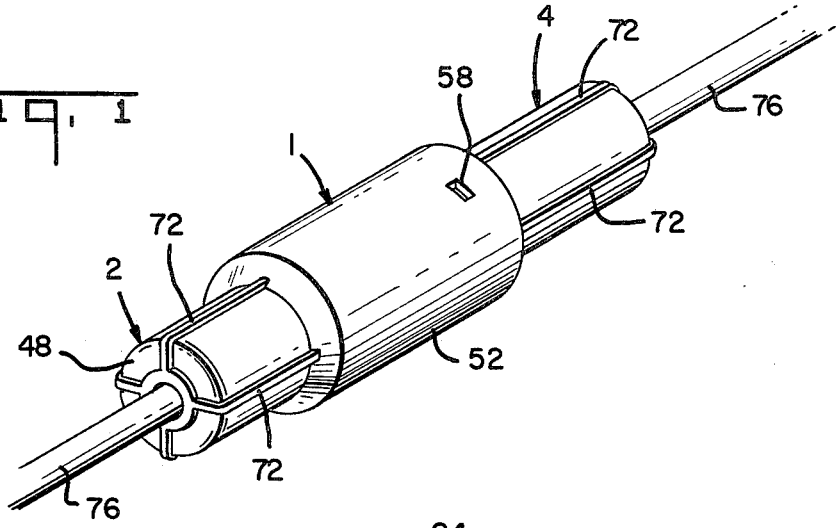
FIG. 1 is an enlarged fragmentary perspective of a fully assembled fuse holder according to the present invention.
Figure 2:
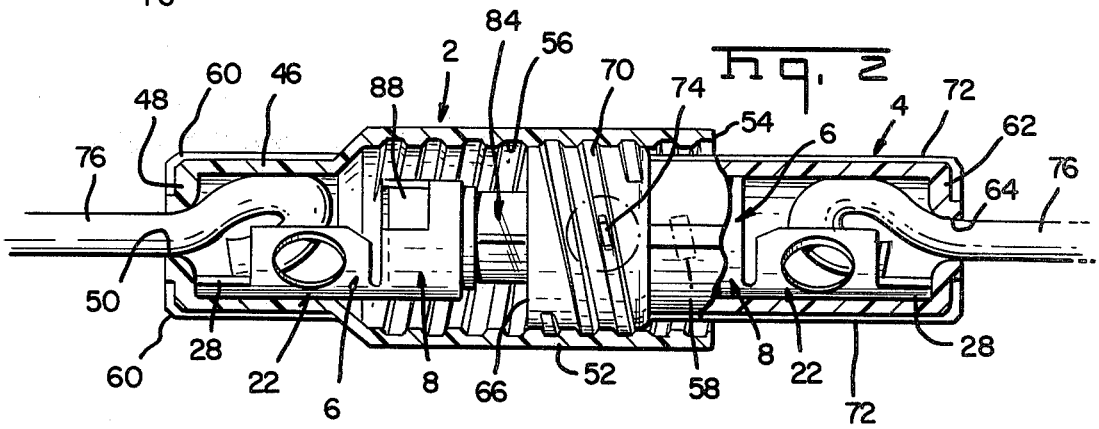
FIG. 2 is an enlarged elevation in section of the fuse holder shown in FIG. 1.
Figure 3:
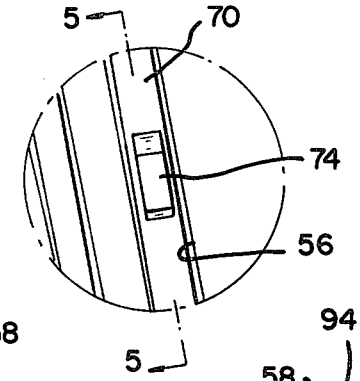
FIG. 3 is an enlarged fragmentary elevation of a portion of FIG. 2 which is outlined in phantom.
Figure 5:
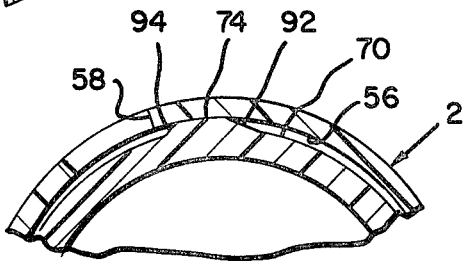
Figures 5, 6, 7:
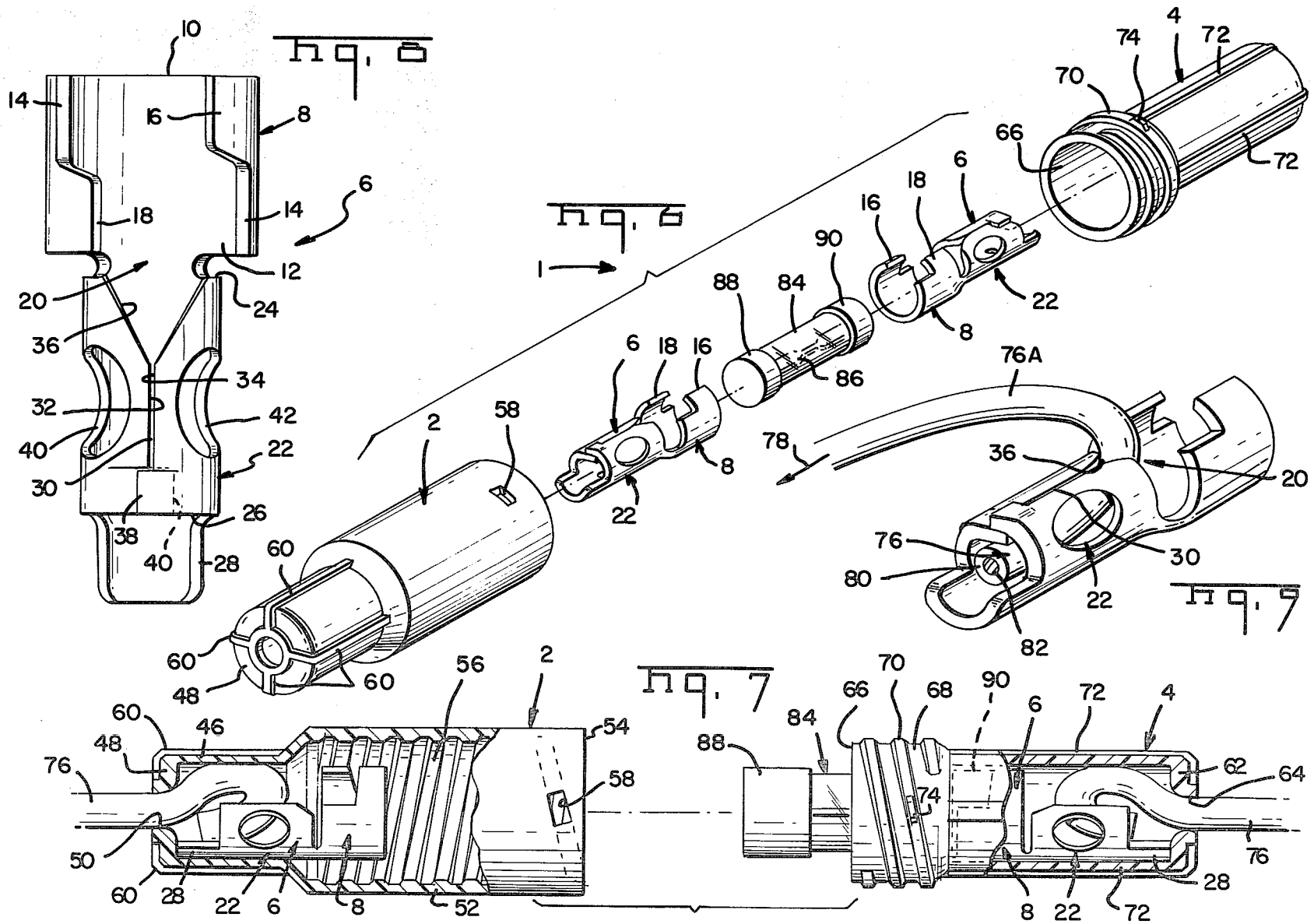
FIG. 6 is a perspective with parts in exploded configuration illustrating the component parts of the fuse holder prior to assembly.
FIG. 7 is an elevation with parts partially broken away to illustrate the details of the two piece housing partially assembled prepatory to connection together.

With more particular reference to FIGS. 1 and 6 of the drawings, a fuse holder according to the present invention is indicated generally at 1 and includes a first dielectric housing portion 2, a second dielectric housing portion 4, and a pair of similar electrical terminals 6.

FIG. 8 illustrates the details of one of the terminals 6. The terminal is stamped and formed from a single piece of metal strip which is rolled into a generally barrel or sleeve form configuration. In particular, the terminal includes an enlarged sleeve form portion 8 serving as a fuse receiving socket. The socket includes a first, generally circular, open end 10 and an opposite, second, generally circular open end 12. A relatively wide longitudinal open seam 14 extends from the end 10 to the other end 12 providing a generally split sleeve socket configuration. An integral pair of flanges or flaps 16 and 18 project laterally into the open seam 14 and are spaced generally longitudinally along the open seam 14. The socket portion 8 is integral with a web portion 20 which joins the socket portion to a reduced diameter, sleeve form, wire terminating, barrel portion 22. The barrel portion is provided with a first open end 24 joined by the web 20 to the end 12 of the socket 8. An opposite open circular end 26 of the wire terminating barrel portion 22 is provided with an integral, longitudinally projecting tab 28. The tab is integral with one side of the barrel portion 22. At the opposite side, the barrel portion is provided with a longitudinally extending open seam 30 defined between a pair of parallel spaced, wire gripping and insulation slicing, jaws 32 and 34. The seam 30 includes an outwardly diverging portion 36 communicating with the end 24 and providing a funnel entry for introduction of an insulation covered wire into and along the open seam, so that the jaws 32 and 34 will slice through the insulation of the wire and engage opposite sides of the conductor portion of the wire, to establish an electrical connection. The barrel portion 22 is provided with integral flaps 38 and 40, which overlap each other adjacent the end 26 and define a terminus for the open seam 30 which limits traverse of a wire along the seam. The barrel 22 further is provided with a pair of circular enlarged openings 40 and 42 on either side of the seam 30, which eliminate sections of metal in the barrel circumference, which provides for uniform stress over the barrel and which reduces the stiffness of the barrel, so that as a wire enters and traverses along the slot 30, the barrel will tend to resiliently expand over a wide range of resilient deflection, allowing the seam to be wedged open by the presence of a wide range of wire diameters. In this manner the barrel is sufficiently stiff to force the jaws 32 and 34 to penetrate and slice through the insulation, but is sufficiently resilient to be opened and to avoid slicing through the conductor of the wire.

FIG. 7 more particularly shows the details of the housing portions 2 and 4. The housing portion 2 is fabricated from a single piece of dielectric plastics material and includes a reduced diameter sleeve portion 46 provided with an end wall 48 having a central opening 50 therethrough. The sleeve portion 46 opens into an enlarged diameter sleeve portion 52 having an open end 54. A helical trapezoidal section groove 56 is provided in the inner cylindrical side wall of the sleeve portion 52 and communicates with the open end 54. A generally rectangular aperture 58 is provided through the wall of the sleeve portion 52 and communicates with a beginning portion of the groove 56 at a location adjacent the end 54. The reduced sleeve portion 46 is provided on its periphery with circumferentially spaced projecting ribs 60 which allow for ease in manually gripping the housing.

Yet with reference to FIG. 7 the housing portion 4 is generally of dielectric cylindrical sleeve configuration provided with an end wall 62 having a wire receiving aperture 64 therethrough. The opposite end 66 of the housing portion 4 is open and is provided with a relatively thickened, cylindrical wall portion 68 adjacent thereto. An integral projecting helical rib 70 is provided on the exterior of the thickened section 68. The remainder of the housing portion 4 is provided with a plurality of longitudinal, circumferentially spaced projecting ribs 72 which allow for ease in manually gripping the housing portion.

The rib 70 is provided with an integral projection or latch 74 of a size which will allow traverse thereof into and along the helical groove 56 of the other housing portion 2 as the helical rib 70 is traversed also helically into and along the groove 56 in order to threadably secure together the housing portions 4 and 2.

Assembly of the component parts is described with reference to FIGS. 6, 7 and 8. An insulation covered wire 76 is first passed through a corresponding housing portion 2 or 4. The wire then is electrically connected in a corresponding barrel portion 22 of a corresponding terminal 6, by first inserting an end portion of the wire, as shon in FIG. 8, into the wire receiving opening 36, and then into and longitudinally along the interior of the barrel portion 22. The remainder 76A of the wire is then looped outwardly of the seam entryway 36. The remainder of the wire is then pulled in a direction, indicated by the arrow 78, which is parallel with the open seam 30. The wire thereby is looped back over itself and forced to traverse into and along the open seam 30. The jaws defining the open seam will slice through the insulation 80 of the wire and will grippingly engage opposite sides of the conductor 82 of the wire. Presence of the conductor 82 between the jaws will widen the open seam 30 to prevent cutting of the wire and also to accommodate conductors of different sizes. Subsequent to termination of a corresponding wire, the corresponding housing portion 2 is traversed along the length of the wire until the terminal 6 engages the end wall 48. The tab 28 abuts the end wall 48 in order to insure sufficient clearance between the end wall and the barrel portion 22 to accommodate the looped portion of the wire 76. In similar fashion, a suitable clearance is provided by engagement of the tab 28 against the end wall 62 of the housing portion 4 for the looped over portion of the wire and for the barrel 22 to allow expansion thereof. Sharp corners of the tab are radiused to allow spinning of the housing with the barrel stationary to avoid twisting of the wire.

A cartridge type fuse is illustrated generally at 84 having a fusible conducting element 36 electrically joined to cylindrical, conductive end caps 88 and 90 at ends of the fuse 84. FIG. 7 illustrates assembly of the fuse end 90 into the open end 66 of the housing portion 4 until insertion into the socket portion 8 of the terminal 6. To complete the assembly, the housing portion 2 is threadably secured to the housing portion 4, the helical rib 70 and the projection 74 thereof threadably entering into and along the helical groove 56. The housing portion 2 is threadably advanced over the housing portion 4 thereby, until the socket portion 8 of the terminal 22 within the housing portion 2 is received over the fuse end 88.

Each socket portion 8 is resiliently expanded in diameter upon wedgingly receiving a corresponding end of the fuse therein. Fuses of different diameters are thereby accommodated. The expanded socket will resiliently grip a corresponding end of the fuse to establish a good electrical connection therewith. The flanges 16 and 18 circumferentially wrap over the fuse end in opposite directions, and are longitudinally spaced along the conductive ends of the fuse, which improves both the longitudinal and the circumferential wrapped engagement of the sockets on the cylindrical, conductive ends of the fuse. A good electrical and mechanical connection is obtained thereby.

Reference is made to FIGS. 2, 3, 4 and 5 wherein the projection 74 is illustrated as slideably traversed along the groove 56. The projection 74 also is radially projected outwardly of the rib 70 into compressed frictional engagement against the bottom of the groove 56, serving to frictionally lock the housing portions in desired telescoped relationship, so that threadable uncoupling is prevented. The housing portions are threadably adjustable to accommodate different lengths of fuses. The latch or projection 74 serves to frictionally lock the housing portions together at whatever their adjusted positions.

Figure 4:
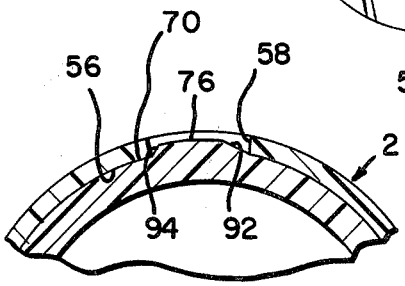
FIGS. 4 and 5 are enlarged diagramatic views appearing as fragmentary sections taken generally through the phantom outlined portions of FIG. 2.

When threadably coupling the housing portions together, FIG. 4 illustrates that the projection 74 is of a size to enter the aperture 58. FIGS. 4 and 5 illustrate the projection 76 being provided with a sloped surface 92 which allows the projection to wedgingly traverse past the aperture 58 and along the helical groove 56 as the housing portions are threadably coupled together. The other side of the projection 94 is relatively steep, as compared to the sloped surface 92. Thereby as the housing portions are threadably uncoupled from each other, the surface 94 will latchingly register within the opening 58 to prevent inadvertent separation of the housing portions 2 and 4 until a sufficient force is applied to forceably pass the projection outwardly of the aperture 58 as the housing portions are being threadably uncoupled.

What has been described and shown in a preferred embodiment of the present invention. Other embodiments and modifications of the invention are intended to be covered by the spirit and scope of the claims.

What is claimed is:

1. In a fuse holder having first and second telescoping housing sections threadably secured together and containing a wire terminating electrical terminal having a resilient socket portion for pluggable connection to a fuse, the improvement comprising:

each said terminal having a sleeve portion connected to said socket portion by a web of said terminal, said sleeve portion having a wire receiving, longitudinal open seam defined between wire gripping and insulation slicing jaws, said seam including an enlarged open portion which communicates with one open end of said sleeve portion and which is spaced from said socket portion to define a wire receiving entry to said seam, so that an insulated wire, inserted into said entry and disposed longitudinally within said sleeve, includes a portion thereof looped back upon itself and pulled into and along said seam for slicing penetration of said jaws into the wire insulation and into engagement on the conductor portion of said wire, each said terminal including an integral tab projecting outwardly from said sleeve portion and engaged on an end of a corresponding housing section to define a space between said housing section and said sleeve portion which receives said looped back portion of a corresponding wire.

2. The improvement as recited in claim 1, wherein, one said housing section includes a helical groove, the other said housing section includes an external projecting helical rib for threaded advancement in and along said helical groove for adjustably positioning said housing sections in desired telescoped relationship, said helical rib includes a projection frictionally engaging in and along said helical groove for frictionally locking said housing sections in desired telescoped relationship, and detent means in alignment with said helical groove for detented receipt of said projection therein to prevent separation of said housing sections, one from the other.

3. The improvement as recited in claim 1, wherein, each said end of a corresponding housing section includes a central opening through which a corresponding said wire projects, and each said tab portion being devoid of sharp corners, so that said housing sections spin with said terminals stationary to avoid twisting of said wires.

4. The improvement as recited in claim 3, wherein, one said housing section includes a helical groove, the other said housing section includes an integral projecting helical rib for threaded advancement in and along said helical groove for adjustably positioning said housing sections in desired telescoped relationship, said helical rib includes a projection frictionally engaging in and along said helical groove for frictionally locking said housing sections in desired telescoped relationship, and detent means in alignment with said helical groove for detented receipt of said projection therein to prevent separation of said housing sections, one from the other.

5. The improvement as recited in claim 3, wherein, each said resilient socket portion includes opposite open ends and an open seam extending longitudinally between said ends, and said socket portion is provided with integral flaps spaced longitudinally along said open seam and projecting into said open seam for circumferential wrapping engagement on a fuse.

6. In a fuse holder having first and second telescoping housing sections threadably secured together and containing a wire terminating electrical terminal having a resileint socket portion for plugable connection to a fuse, the improvement comprising:

each said terminal having a sleeve portion provided with one open end opposite a first open end of said socket portion, a web of said terminal connecting said one open end of said sleeve portion with said first open end of said socket portion, said sleeve portion having a wire receiving, longitudinal open seam defined between wire gripping and insulation slicing jaws, said sleeve portion having an open enlarged entry communicating with said open seam and with said one open end of said sleeve, so that an insulated wire, inserted into said entry and disposed longitudinally within said sleeve, includes a portion thereof looped back upon itself and pulled into and along said seam for slicing penetration of said jaws into the wire insulation and into engagement on the conductor portion of the wire, an integral tab portion projecting outwardly from said sleeve portion and engaged on an end of a corresponding housing section to define a space between said housing section and said sleeve which receives said looped back portion of a corresponding wire, and said socket portion includes a second open end into which an end of a fuse is received, said housing sections being threadably secured together with said tab portions engaged on corresponding ends of said housing sections to advance said fuse along each said socket portion toward said one end of each said sleeve portion.

7. The structure as recited in claim 6, wherein, each said end of a corresponding housing section includes a central opening through which a corresponding said wire projects, and each said tab portion being devoid of sharp corners, so that said housing sections spin with said terminals stationary to avoid twisting of said wires.

* * * * *